US010633136B2

(12) United States Patent
Dominici et al.

(10) Patent No.: US 10,633,136 B2
(45) Date of Patent: Apr. 28, 2020

(54) METHOD AND MACHINE FOR CLOSING SQUARE OR RECTANGULAR CROSS-SECTION BOXES BY REDUCING THE HEIGHT OF SAME TO THAT OF THE CONTENTS THEREOF

(71) Applicant: B+ EQUIPMENT, Aubagne (FR)

(72) Inventors: Bernard Dominici, Gemenos (FR); Robert Casanova, Marseilles (FR); Joris Peters, Aubagne (FR); Claude Durand, Gemenos (FR)

(73) Assignee: B+ Equipment, Aubagne (FR)

( * ) Notice: Subject to any disclaimer, the term of this patent is extended or adjusted under 35 U.S.C. 154(b) by 516 days.

(21) Appl. No.: 15/115,090

(22) PCT Filed: Feb. 19, 2015

(86) PCT No.: PCT/FR2015/050399

§ 371 (c)(1),
(2) Date: Jul. 28, 2016

(87) PCT Pub. No.: WO2015/124869

PCT Pub. Date: Aug. 27, 2015

(65) Prior Publication Data

US 2017/0001746 A1 Jan. 5, 2017

(30) Foreign Application Priority Data

Feb. 24, 2014 (FR) ..... 14 51459

(51) Int. Cl.
*B65B 59/00* (2006.01)
*B65B 51/00* (2006.01)
(Continued)

(52) U.S. Cl.
CPC ..... *B65B 59/00* (2013.01); *B65B 7/20* (2013.01); *B65B 51/00* (2013.01); *B65B 51/067* (2013.01); *B65B 61/00* (2013.01); *B65B 2210/04* (2013.01)

(58) Field of Classification Search
CPC ..... B65B 51/00; B65B 51/51; B65B 51/067; B65B 61/005; B65B 61/00;
(Continued)

(56) References Cited

U.S. PATENT DOCUMENTS 3,894,380 A * 7/1975 Poulsen ..... B65B 7/20 53/75
4,562,686 A * 1/1986 Focke ..... B65B 61/00 493/183

(Continued)

*Primary Examiner* — Robert F Long
*Assistant Examiner* — Christopher Robin Kim
(74) *Attorney, Agent, or Firm* — Jon M. Isaacson

(57) ABSTRACT

Method and machine for reducing the height of a box without removing a section of the material of the box and without the use of any cutting tool whatsoever, but by folding high sections of side walls towards the centre of the box. The method includes: breaking the connections between the side walls along the upper section of the vertical ridges of the box, from the height of the vertical walls of the box to the level of the top of the stack of objects previously positioned in the box, by exerting a force, directed towards the exterior of the box, on the high section of at least two of the side walls; simultaneously folding towards the exterior the high sections on which force is exerted; then folding all the high sections towards the interior of the box, in order to bring the side walls into a substantially horizontal plane.

10 Claims, 9 Drawing Sheets

(51) Int. Cl.

| | |
|---|---|
| ***B65B 61/00*** | (2006.01) |
| ***B65B 7/20*** | (2006.01) |
| ***B65B 51/06*** | (2006.01) |

(58) Field of Classification Search

CPC ..... B65B 2210/04; B65B 59/00; B65B 43/32; B65B 43/08; B65B 7/20; B65D 5/48008; B65D 5/247; B65D 5/10; B31B 50/00; B31B 50/73; B31B 50/78; B31B 50/782; B31B 2100/00; B31B 2105/002; B31B 2120/00; B31B 2160/00; B31B 2210/04

USPC ... 53/373.2–373.6, 456, 458, 467, 472, 473, 53/491, 564, 235, 284.5, 376.4, 377.3, 53/503, 504; 229/103.2, 155; 493/51, 493/68, 70, 79, 80

See application file for complete search history.

(56) References Cited

U.S. PATENT DOCUMENTS

| | | | | | |
|---|---|---|---|---|---|
| 5,115,625 | A * | 5/1992 | Barbulesco | B65B 5/024 | 53/242 |
| 5,379,573 | A * | 1/1995 | Greenwell | B65B 7/20 | 53/376.5 |
| 6,129,211 | A * | 10/2000 | Prakken | B65D 5/5253 | 206/526 |
| 6,676,009 | B1 * | 1/2004 | Rose | B65D 5/0005 | 229/101 |
| 2013/0036716 | A1 * | 2/2013 | Tsutsumi | B65B 43/305 | 53/564 |
| 2015/0119216 | A1 * | 4/2015 | Benterman | B65B 59/02 | 493/22 |
| 2015/0151860 | A1 * | 6/2015 | Sain | B65B 7/20 | 53/376.4 |
| 2015/0224731 | A1 * | 8/2015 | Ponti | B65D 5/2095 | 493/59 |
| 2016/0096658 | A1 * | 4/2016 | Fath | B65B 5/024 | 206/273 |

* cited by examiner

METHOD AND MACHINE FOR CLOSING SQUARE OR RECTANGULAR CROSS-SECTION BOXES BY REDUCING THE HEIGHT OF SAME TO THAT OF THE CONTENTS THEREOF

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention concerns a method for closing boxes of cardboard, corrugated board or analog sheet material with a square or rectangular cross-section, while reducing, when this turns out to be desirable, the height of these boxes to that of their content. It is also about a machine capable of carrying out the various stages of this method.

The technical field of the invention is that of machines for processing, cutting, setting up or closing of packaging or of manufacturing and implementation of methods and cushioning materials for such packaging.

The present invention concerns more particularly the closure and height adjustment of boxes used for the handling of single or multiple-item orders and more generally of boxes used for the packaging, prior to shipping them to customers or other addressees, of diverse items varying in number and unit volume, and thus also in overall volume, from one box to the next.

2. Description of Related Art Including Information Disclosed under 37 CFR 1.97 and 37 CFR 1.98.

It is known that boxes of this type are formed by machines starting with one or several panels of rigid and pliable material, featuring various flaps and fold-downs that are inter-connected using either glue or adhesive tape.

One is familiar with boxes which, after having been formed, consist of five walls, i.e., a square or rectangular base and a belt composed of four side walls inter-connected at right angles forming ridges. Boxes of this type are for example known under the name of "American half-boxes", "trays" or "bell boxes". These boxes are usually, after having been filled, closed by a lid. One is also familiar with lids which have four flaps which are folded down and glued on the sides of the box. Also known are lids where the different flaps have previously been shaped by nesting or by gluing; these lids are placed over the top of the box and become one with the box through gluing, stapling or a metal or plastic strip.

One is also familiar with boxes which, after forming, are composed of a base and four side walls like the boxes described above, as well as of four upper flaps. Each of these upper flaps is connected to one of the side walls of the box through a crease line. The boxes of this type are known as "American boxes". Once filled, these boxes are closed by folding the four upper flaps in a horizontal plane and keeping these flaps in place through gluing, stapling or a metal or plastic strip.

All boxes described above, and, generally speaking, most boxes used for the packaging of objects share the common characteristic of providing a constant useful volume, once they have been set up and closed.

Various products are often employed by users or integrated in the box-forming and closing machines, to immobilize the various, previously packed objects the overall volume of which can vary from one box to the next.

This solution presents numerous disadvantages. In effect:

These products are frequently costly;

except when they are made of the same material as the packaging itself, they must necessarily be separated from the carton material prior to collection and possible recycling of the corresponding waste material; on the other hand, the materials used are in most cases difficult to recycle; this collection and this recycling are complex and very costly operation;

their implementation is difficult and requires either complex automated machinery or many hours of manual labor; the cost of these operations is accordingly high;

the volume shipped, which ideally should be equal to the volume of the manufactured box, is, most often, vastly superior to the actual volume used, which is equal to the volume of the objects placed inside the box; this results in high shipping costs for said boxes.

One also knows about methods consisting of reducing the box height in order to bring it in line as much as possible with the height of the packed goods.

One is familiar, in particular, with a method (EP-2584802A1) which consists of cropping and discarding the high portion of boxes, situated above the upper level of the stack of objects placed inside said boxes so as to reduce its height to the useful height of the latter. This document describes a method for reducing the height of box made of a pliable material, consisting of a base and at least four side walls, up to the top level of the stack of objects previously placed in said box, without removing a portion of material of said box, but by folding the high sections of said side walls towards the center of said box. According to this method:

the links between said side walls are cut along the upper portion of the vertical ridges of said box, between the top of said vertical walls of the box and the level of the top of said stack of objects previously placed in the box, all high sections of said side walls are then folded back toward the inside of said box in order to bring them back into an essentially horizontal plane.

Analog methods are described in documents in FR-2292626, FR-2919520, EP-1832413.

The method described in document EP-2684802 presents disadvantages which are present in the three other aforementioned documents. In particular:

cutting the box is a delicate operation which implies the utilization of cutting tools which are dangerous and subject to rapid wear which means that they have to be frequently sharpened or replaced;

automatic removal of the cut upper portion of the box is a difficult operation which is also prone to generate dust and other waste which need to be collected and eliminated;

automatization of this method requires the availability of complex machines.

Document EP 2684802 also describes a machine for the cushioning and containment of objects inside a box made of pliable material, for example cardboard, consisting of a base of square or rectangular or approximately square or rectangular shape, and of four side walls, this machine featuring tooling for adapting the height of the useful volume of the box to the height of the stack of objects placed inside it and for closing said box, and means for either moving this tooling so as to position it above the box or for moving said box to position it below said tooling.

Similar machines are known from documents FR-2292626, FR-2919520, and EP-1 832413.

Also known are documents EP-1817483 and FR-2818230 which describe a machine and a method which consists of cutting the four vertical edges of a box, from its top to a height corresponding essentially to that of the top of the stack of packed objects and then create a horizontal scoring (or groove) on each of the four side walls of the box at this same height, and finally to fold towards the inside of the box, around these horizontal scores and at an essentially right angle, the upper portion of these four side walls. This method also allows adjusting the height of the box by reducing it to the useful height. Furthermore, when the distance between the top of the stack of objects and the top of the box is equal to or greater than the half width of the box, the upper portion of one of the two side walls parallel to the length of the box must at least come into contact and possibly pass above the high portion of the second side wall parallel to the length of the box during the folding, so that they occupy, once folding is complete, the entire upper surface of the box, possibly by one partially overlapping the other in the middle of said box. It is thus possible to simply close the box by providing a means to maintain said high sections in the folded position, for example through gluing.

This last method presents nevertheless some disadvantages, such as:

cutting the four vertical ridges is a delicate operation which implies the utilization of cutting tools which are dangerous and subject to rapid wear;

these cutting operations generate dust and other waste which pollute the context of the box, as they can fall into it during said cutting operations.

The problem at hand is therefore to provide a means for reducing the height of a box, featuring a base and at least four side walls, as closely as possible to the objects previously placed into this box and to simultaneously close said box while using for this purpose the material the box is made of, without supplying any additional board material and without the use of any cutting tool whatsoever.

BRIEF SUMMARY OF THE INVENTION

The solution to the problem consists of providing a method and a machine for reducing the height of a box of foldable material, composed of a base and at least four side walls, assembled at right angles by forming ridges up to the level of the top of the pile of objects previously placed in said box, without removing any portion of the material of said box or use of any cutting tool, but by folding the high sections of said side walls towards the center of the box.

The method used for achieving the height reduction of said box is remarkable, namely:

by breaking the connections between said side walls along the upper portion of the vertical ridges of a box made of a foldable material, from the top of said side walls of this box to the level of the top of said stack of objects previously positioned in the latter, by exerting a force directed towards the exterior of said box, on the high portion, situated above the level of the top of said stack of objects, of at least two of said side walls;

by simultaneously folding, towards the outside of said box, said high sections on which said force is exerted;

by then folding all high sections of said side walls towards the inside of said box in order to bring them into an essentially horizontal plane, parallel to the base of the box.

In an advantageous implementation of the method of the invention, after folding all said high sections into an essentially horizontal plane, and parallel to the base of the box, these completely obturate the opening of said box and said high sections are kept in said horizontal plane, for example by gluing, strapping, applying adhesive tape, wrapping with plastic film or a sheet of paper and any other equivalent means known as such or available to the expert, with the effect of keeping said box closed.

Advantageously, to exert said force on said side walls and fold the upper sections of the side walls towards the exterior of said box, said side walls are seized in an area situated between the top of said box and the level of the top of said stack of objects and preferably in proximity of said vertical ridges, by means of gripping elements, for example constituted by clamps featuring each at least two jaws, one acting on the outer face of the wall, the other acting on the inner face of the wall, then each of said clamps and consequently each of the high sections is pivoted in the direction of the exterior of said box, around a rotational axis essentially situated on said walls and at the level of the top of said stack of objects.

On the other hand, the folding back of the high sections separated from the side walls, in the direction of the center of the box, is performed by pushing elements.

In an advantageous implementation, in order to seize said side walls by means of said clamps, the box is first moved towards said clamp assembly, or the clamp assembly is moved towards said box, in a motion perpendicular to the base of the box and the corresponding movement is stopped as soon as, for example by use of a sensor, a relative movement is detected between said clamps and a feeler the shape and general dimensions of which match substantially those of said base, when said feeler comes into contact with the top of said stack of objects.

Advantageously, before folding the upper sections of said side walls towards the interior of said box, a score (also called a groove) is applied at the level of the rotational axis around which the folding is to take place, situated on said side walls and at the level of the top of said stack of objects.

This score may be made over a reduced length, so as to constitute the beginning of a fold, facilitating the formation of a continuous folding line during the crimping of the high sections of the side walls which are not interconnected, in direction of the center of the box, [and] this folding start can be performed when the clamps are ready to seize the upper sections of the side walls of the box 1.

In an advantageous implementation, the box used features cuts of a reduced height and at most equal to the half width of the box, and made from the top of the box, at the location of the vertical ridges where the connections between said side walls are situated.

Advantageously, a bead of glue is put down on the internal face of at least one of said upper sections and the non-glued upper sections are folded first, then the already glued upper portion is folded so that said glue bead will join together at least two of said upper sections and maintains all upper sections in an essentially horizontal plane.

In an advantageous implementation a bead of glue is put on the internal face of at least one of said upper sections as well as one or more beads of glue on the internal and/or external face of at least one more of said upper sections and first the unglued upper sections are folded, then said already glued upper sections are folded successively so that said beads of glue do not come into contact with said objects but join together several of said upper sections and maintain all the upper sections in an essentially horizontal plane.

Advantageously, said glue beads are parallel to each other and the deposition of the glue beads is made by projection of glue from a glue container using fixed glue nozzles, while said box is moved in a direction parallel to said glue beads.

The implementation of this method allows reducing the height of the box to the useful height corresponding to the height of the stack of objects previously positioned in said box and this height reduction is achieved without removal of any material or use of any cutting tool whatsoever.

Implementation of this method allows, on the other hand, closing said box without adding any material, but using only the material which constitutes the body of said box.

In this manner, the invention provides an efficient, robust and economical method for reducing the volume of said box and to close it, and this in the absence of any cutting tool subject to wear and the fact that it is not necessary to provide one or several additional panels of material.

BRIEF DESCRIPTION OF THE DRAWINGS

The advantages provided by the invention will be better understood through the following description which makes reference to the attached drawings which illustrate, without any limitation, a particular implementation of the method according to the invention.

Reference is made to the drawings to describe interesting, although by no means limiting examples of implementation of the method according to the invention.

DETAILED DESCRIPTION OF THE INVENTION

In the following disclosure, terms such as "upper sections", "lower sections", "side walls", "horizontal", "upper" are used while considering a box resting on its base on a horizontal surface. These terms do, of course, not have any limiting connotation.

Figure 1:
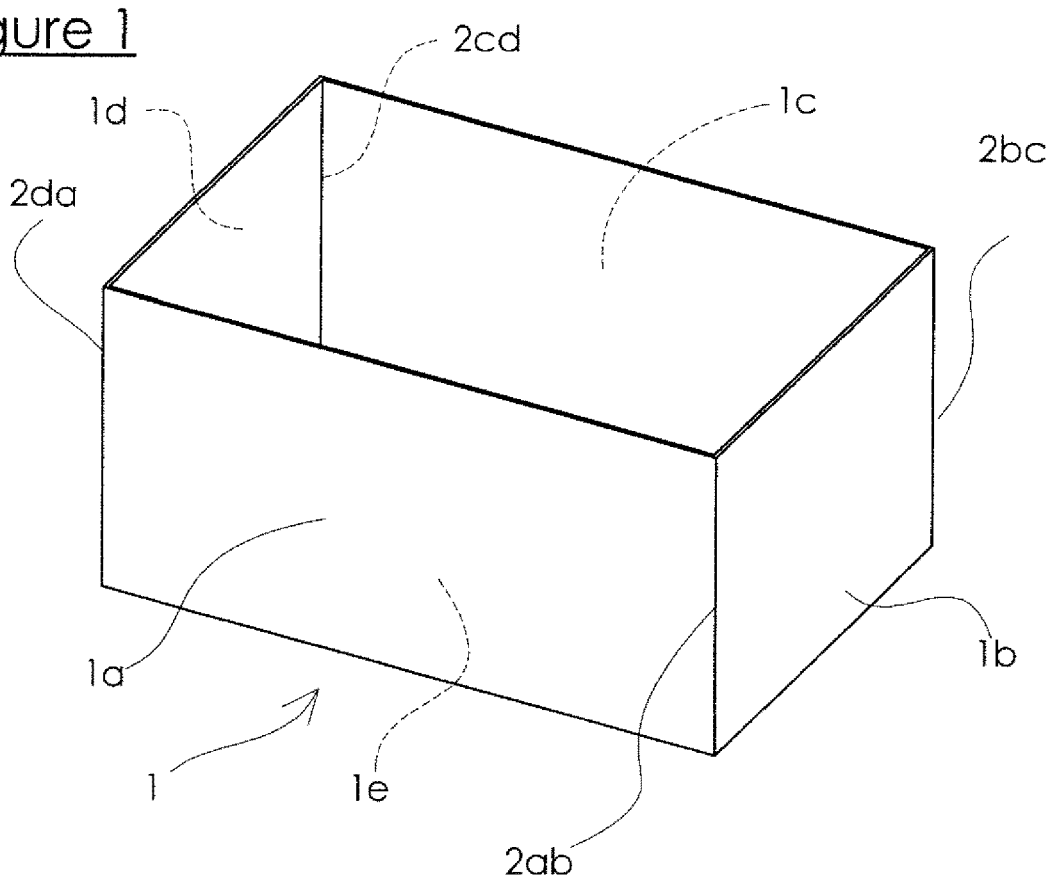
FIG. 1 is an isometric view of an empty box usable for the implementation of the method according to the invention.

FIG. 1 shows a box 1 which is composed of a base 1*e* and of side walls 1*a*, 1*b*, 1*c* and 1*d* which are connected to each other at right angles.

One also sees, on this figure, the vertical ridges 2*ab*, 2*bc*, 2*cd*, and 2*da* which each connect two of said side walls.

According to the example shown, the base 1*e* has a rectangular shape, so that the box has the shape of a rectangular parallelepiped. One can see that in this example, the side walls 1*a* and 1*c* are parallel to the length of the box 1 and that the side walls 1*b* and 1*d* are parallel to the width of said box 1.

It is emphasized that the base and the side walls could have a different shape, for example a square shape or a generally square or rectangular shape with cut corners.

As indicated, this box 1 may be made of corrugated board, solid board or any other equivalent foldable sheet material presenting the necessary rigidity and known as such or available to the expert.

Figure 2:
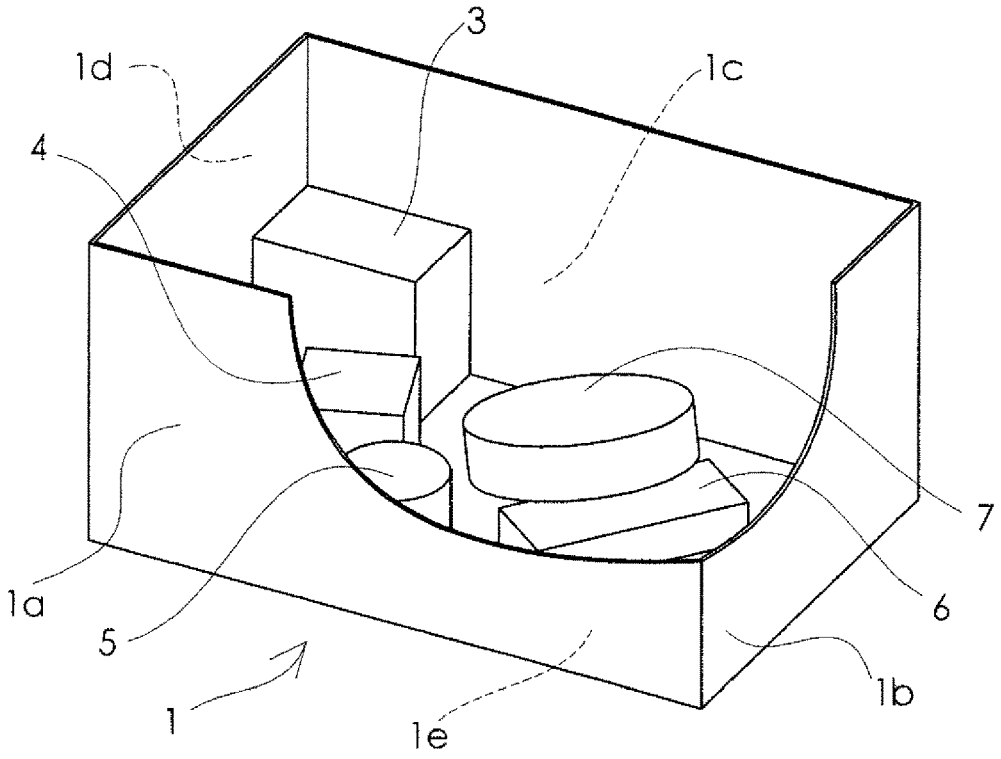
FIG. 2 is an isometric view, with a break-away, of a box of the same type, filled with a certain number of objects of various shapes and dimensions.

FIG. 2 shows the box 1, composed of the base 1*e* and the side walls 1*a*, 1*b*, 1*c*, and 1*d*, into which has been placed a certain number of objects 3, 4, 5, 6, and 7 of various shapes and dimensions. The number and the size of the objects can be any whatsoever, as well as their positioning in the box. The objects may also be stacked on top of each other, if necessary. In order to justify and authorize the implementation of the method according to the invention, the height of the stack of objects must be substantially below the height of the box, which is almost always the case.

Figure 3:
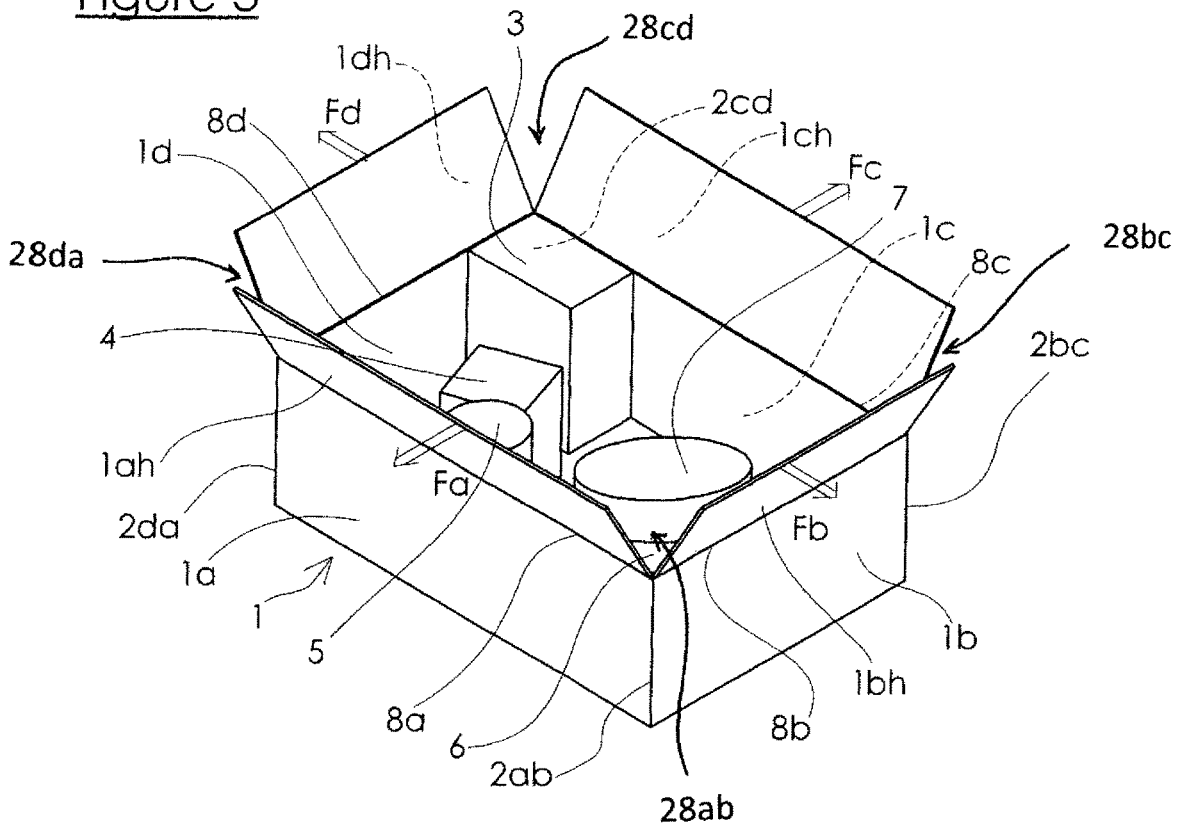
FIG. 3 is an isometric view of the box after implementation of the first steps of the method according to the invention.

FIG. 3 shows said box 1 after the first steps of implementation of the method according to the invention.

On this figure are shown the objects 3, 4, 5, 6 and 7 which have previously been positioned in the box 1.

Also shown are the upper sections 1*ah*, 1*bh*, 1*ch* and 1*dh* of each of the side walls 1*a*, 1*b*, 1*c* and 1*d* of the box 1, said upper sections being situated above the top of the stack of objects, i.e., in the example shown, above the level of the upper face of object 3.

One observes that the connections between said side walls, situated at the ridges 2*ab*, 2*bc*, 2*cd* and 2*da* have been partially broken, so that the upper sections 1*ah*, 1*bh*, 1*ch* and 1*dh* of said side walls are no longer interconnected but separated by slits 28*ab*, 28*bc*, 28*cd* and 28*da*. One can also see that said upper sections have been folded towards the exterior of the box 1 by rotation around fold lines 8*a*, 8*b*, 8*c* and 8*d* and it is clear that it is the forces Fa, Fb, Fc and Fd exerted respectively on each of the upper sections 1*ah*, 1*bh*, 1*ch* and 1*dh* which have produced these ruptures and caused these folds. During these folding operations said fold lines 8*a*, 8*b*, 8*c* and 8*d* are created which connect the bottom of the slits resulting from the separation of said upper sections.

It is also clear that it would have been sufficient, in the particular case of implementation of the method shown, to exert a force on the upper portion of two of the four opposing side walls, for example the forces Fa on the upper portion 1*ah* and Fc on the upper portion 1*ch*, or for example the forces Fb on the upper portion 1*bh* and Fd on the upper portion 1*dh*, to cause the rupture of the connections between said four upper sections 1*ah*, 1*bh*, 1*ch*, and 1*dh* two by two, but that, in this case, only two of said upper sections would have been folded towards the exterior of said box 1.

Figure 4:
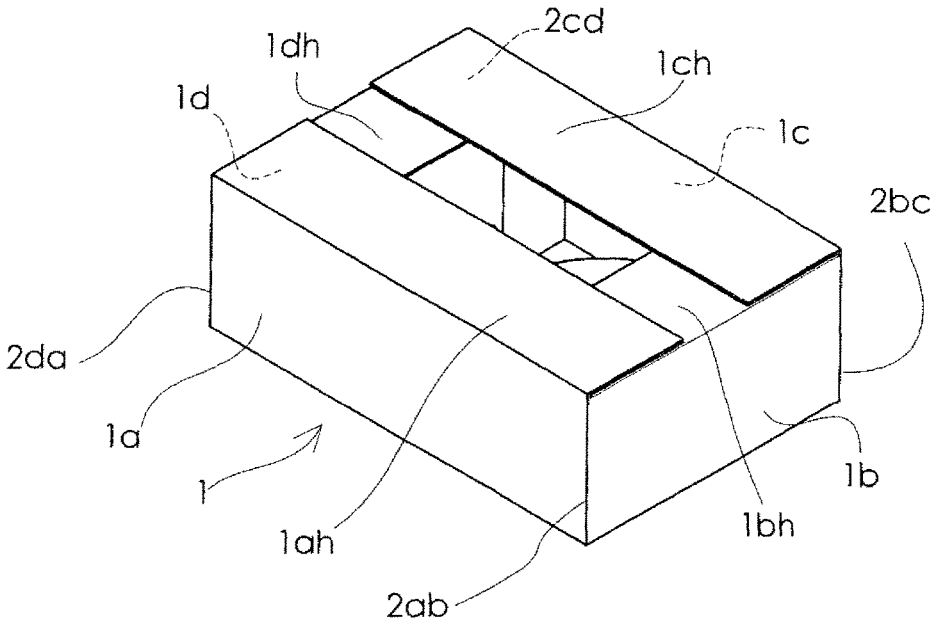
FIG. 4 is an isometric view of a closed box after adaptation of its height to that of its content, according to an example of implementation of the method according to the invention.

FIG. 4 shows said box 1 at a subsequent step of the method according to the invention. One sees in this figure that the four upper sections 1*ah*, 1*bh*, 1*ch*, and 1*dh* of said side walls 1*a*, 1*b*, 1*c*, and 1*d* have been folded towards the interior of the box 1, at an angle essentially equal to 90°, relative to the low portion of said side walls. One sees that the folding of the upper sections 1*bh* and 1*dh* of the narrow sides of the box was done before that of the upper sections 1*ah* and 1*ch*, so that the upper sections 1*ah* and 1*ch* partially cover the upper sections 1*bh* and 1*dh* after the folding.

One sees also that, on the example shown in FIG. 4, the height of the stack of objects is such that the height reduction of the box 1 is only minor, so that, after the folding, said upper sections 1*ah*, 1*bh*, 1*ch*, and 1*dh* do not completely cover the upper face of said box 1, which presents a central opening.

Figure 5:
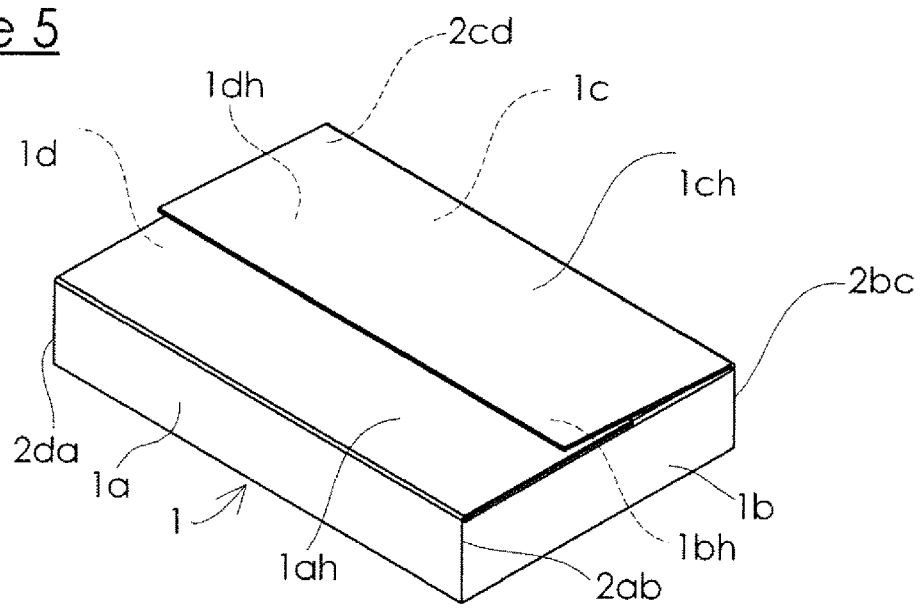
FIG. 5 is an isometric view of a closed box after reduction of its height, according to another example of implementation of the method according to the invention.

FIG. 5 shows said box 1 at the same stage of the method as on FIG. 4 but in another example of implementation of this method.

One sees, on this figure, that the four upper sections 1*ah*, 1*bh*, 1*ch*, and 1*dh* of said side walls 1*a*, 1*b*, 1*c*, and 1*d* have been folded towards the interior of the box 1, at an angle essentially equal to 90°. One sees that the folding of the upper sections 1*bh* and 1*dh* was done before that of the upper sections 1*ah* and 1*ch*, so that the upper sections 1*ah* and 1*ch* do cover the upper sections 1*bh* and 1*dh* after the folding.

One also sees, on the example shown in FIG. 5, that the upper sections 1*ah*, 1*bh*, 1*ch*, and 1*dh* completely cover the upper opening for access to the content of said box 1, after folding of said upper sections in the direction of the center of said box. It is clear that the height of the stack of objects previously positioned in said box in the example shown in FIG. 5, is below the height of the stack of objects previously positioned in said box 1 in the example shown in FIG. 4, so that the height reduction of the box 1 in the example shown in FIG. 5 is consequently greater than the height reduction of said box 1 upper sections 1*ah*, 1*bh*, 1*ch*, and 1*dh* before folding is consequently greater in the example shown in FIG. 5 than in the example shown in FIG. 4. For this reason, the height of said upper sections 1*ah*, 1*bh*, 1*ch* before folding is consequently greater in the example shown in FIG. 5 than in the example shown in FIG. 4, and that, for this same reason, said upper sections 1*ah*, 1*bh*, 1*ch*, and 1*dh* occupy, once folded, a larger surface in the example shown in FIG. 5, which allows to completely cover the opening of said box 1.

It is also clear that, in the case of a box with a rectangular cross-section, such as illustrated in FIGS. 1 to 5, it is the two upper sections 1*ah* and 1*ch* of the side walls 1*a* and 1*c* parallel to the length of the box which, once folded, can completely obturate the opening of said box 1, which is only possible when the height of the stack of objects previously positioned in said box 1 is equal to or less than the initial height of said box 1 minus the half-width of said box 1.

It is thus clear that it suffices to not fill the box 1 above a limit situated at a distance equal to the half-width of said box 1, relative to the height of said box 1, to be able to completely obturate the opening of said box 1 through the implementation of the method according to the invention.

One understands finally that it suffices to maintain in the horizontal plane said folded upper sections 1*ah* and 1*ch*, by means of a fastening method known as such or available to the expert, for example by gluing, strapping, application of adhesive tape, wrapping in plastic film or a sheet of paper or any other equivalent means, which ensures that said box 1 is kept closed.

According to another characteristic disposition of the method of the invention, in order to exert said force Fa, Fb, Fc, and Fd on said side walls 1*a*, 1*b*, 1*c*, and 1*d* and fold back the upper sections 1*ah*, 1*bh*, 1*ch*, and 1*dh* of said side walls towards the exterior of said box 1, the side walls are gripped in an area situated between the top of the box and the level of the top of said stack of objects 3, 4, 5, 6, and 7 and, preferably, in proximity of said vertical ridges 2*ab*, 2*bc*, 2*cd*, and 2*da*, for example using clamps 9*a*1/10*a*1, 9*a*2/10*a*2, 9*b*1/10*b*1, 9*b*2/10*b*2, 9*c*1/10*c*1, 9*c*2/10*c*2, 9*d*1/10*d*1, and 9*d*2/10*d*, featuring, each, at least two jaws, one (9*a*1, 9*a*2, 9*b*1, 9*b*2, 9*c*1, 9*c*2, 9*d*1, and 9*d*2) acting on the external face of the wall, the other one (10*a*1, 10*a*2, 10*b*1, 10*b*2, 10*c*1, 10*c*2, 10*d*1, and 10*d*2) acting on the internal face of the wall. Each clamp 9*a*1/10*a*1, 9*a*2/10*a*2, 9*b*1/10*b*1, 9*b*2/10*b*2, 9*c*1/10*c*1, 9*c*2/10*c*2, 9*d*1/10*d*1, and 9*d*2/10*d*2 includes two jaws of elongated shape, 9*a*1, 9*a*2, 9*b*1, 9*b*2, 9*c*1, 9*c*2, 9*d*1, and 9*d*2, 10*a*1, 10*a*2, 10*b*1, 10*b*2, 10*c*1, 10*c*2, 10*d*1, and 10*d*2 respectively which open and close by means of actuators or other activators (not shown) for exerting at least on one of the jaws and, preferably, on each of said jaws, a force which brings it closer to the jaw situated across from it, on the other side of the side wall of the box.

After positioning the clamps on the upper sections of the side walls of the box, each of said clamps and thereby also each of the upper sections are rotated, in the direction of the exterior of said box 1, around a rotational axis 11*a*, 11*b*, 11*c*, and 11*d* essentially situated on said side walls and on the level of the top of said stack of objects.

Figure 6:
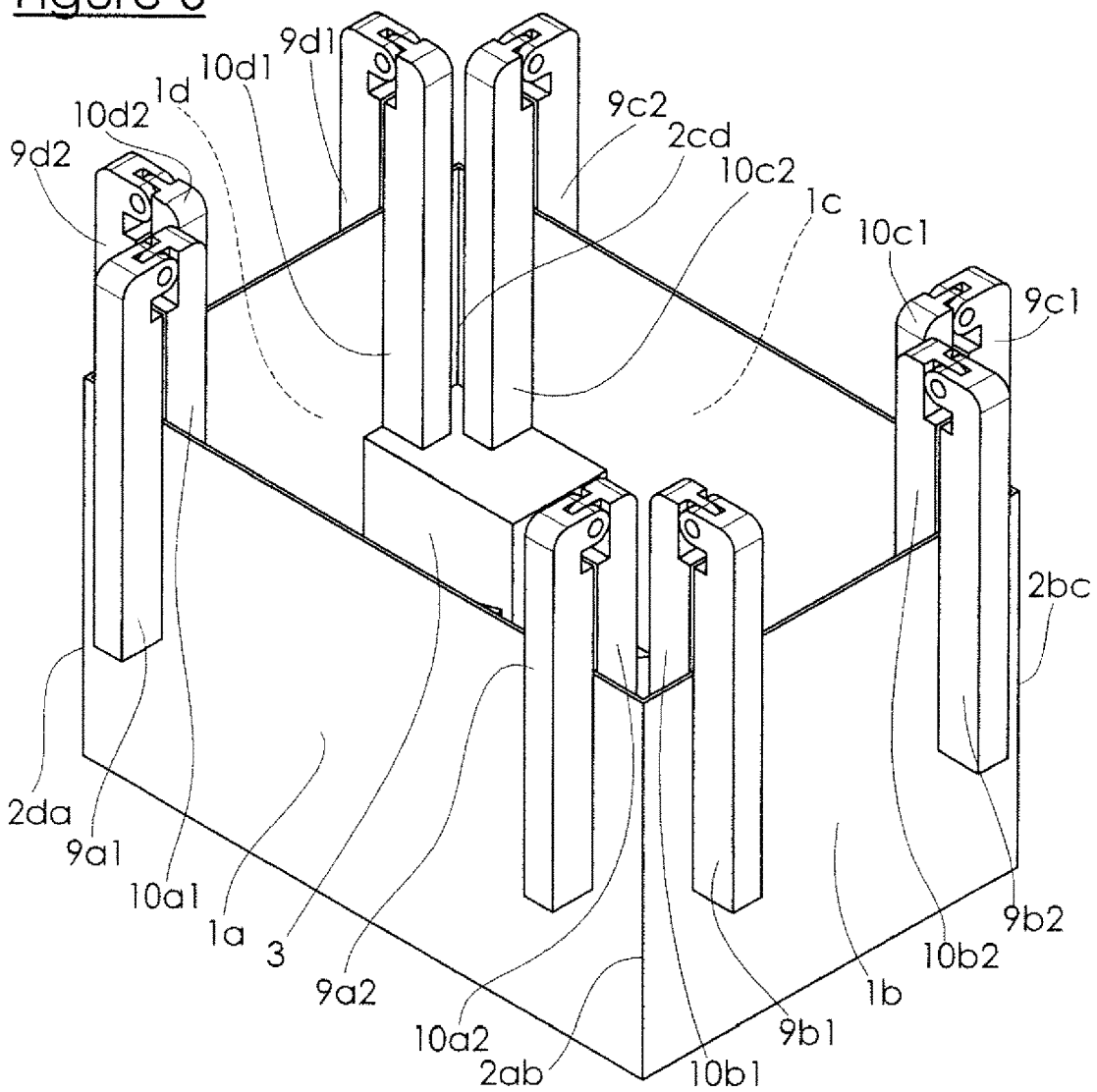
FIG. 6 is an isometric view of a box and of a part of a machine for the implementation of the method according to the invention.

FIG. 6 shows said box 1 at one of the first steps of the method according to the invention.

This figure shows means put into place to grab the upper portion of the side walls 1*a*, 1*b*, 1*c*, and 1*d* of said box 1, in the form of pairs of clamps 9*a*1/10*a*1, 9*a*2/10*a*2, 9*b*1/10*b*1, 9*b*2/10*b*2, 9*c*1/10*c*1, 9*c*2/10*c*2, 9*d*1/10*d*1, and 9*d*2/10*d*2 featuring each two jaws, one 9*a*1, 9*a*2, 9*b*1, 9*b*2, 9*c*1, 9*c*2, 9*d*1, and 9*d*2 acting on the external face of the wall, the other 10*a*1, 10*a*2, 10*b*1, 10*b*2, 10*c*1, 10*c*2, 10*d*1, and 10*d*2 acting on the internal face of the wall.

One sees that, in the example illustrated in FIG. 6, the upper portion of each of said side walls is seized by two clamps and that these clamps are positioned in proximity of the vertical ridges 2*ab*, 2*bc*, 2*cd*, and 2*da* at which level said side walls are inter-connected two by two.

It is clear that it would also be possible to use a single clamp of large size to seize each of said side walls, or also a greater number of not so large clamps.

One sees also, on FIG. 6, that the low end of the jaws of said clamps finds itself at a height essentially equal to the top of the stack of objects previously placed in said box 1, i.e., in the example shown, above the level of the upper face of object 3.

Figure 7:
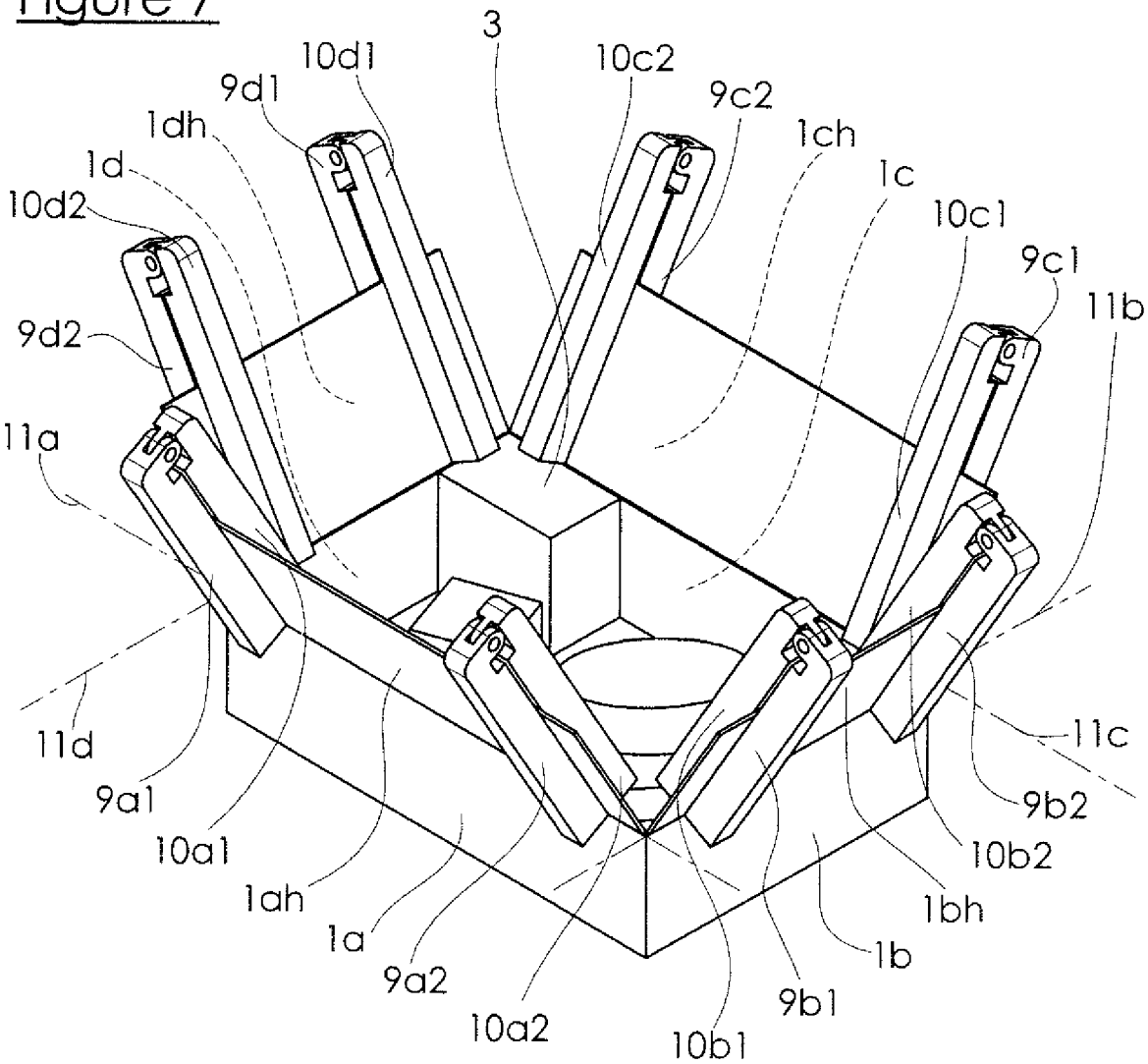
FIG. 7 is an isometric view of the box and of the same part of a machine at another step of the method according to the invention.

FIG. 7 shows said box 1 at the following stage of the method according to the invention.

This figure shows that each of said clamps 9*a*1/10*a*1, 9*a*2/10*a*2, 9*b*1/10*b*1, 9*b*2/10*b*2, 9*c*1/10*c*1, 9*c*2/10*c*2, 9*d*1/10*d*1, and 9*d*2/10*d*2 has swung around a horizontal axis 11*a*, 11*b*, 11*c*, and 11*d* situated on the side wall 1*a*, 1*b*, 1*c*, and 1*d* previously seized by said clamps, at a height essentially equal to that of the low end of the jaws of said clamps which one knows to be essentially identical to the height of the top of the stack of objects previously placed in said box 1.

It is clear that the fact of making said clamps pivot has allowed exerting a tilting force on the upper portion 1*ah*, 1*bh*, 1*ch*, and 1*dh* of said side walls, directed towards the exterior of the box 1 and that this force has transmitted itself on the connections between said upper sections, two by two, and has been able to break these connections and that it is because this break has occurred that said upper sections have been able to be folded towards the exterior of said box.

One sees that said connections have been broken under just the effect of this rotational movement, without the direct action of any element on said connections or the utilization of any cutting tool whatsoever.

It is also clear that it would have sufficed to swing only the clamps 9*a*1/10*a*1, 9*a*2/10*a*2, 9*c*1/10*c*1, and 9*c*2/10*c*2 around the horizontal axes parallel to the length of the box 1, or only the clamps 9*b*1/10*b*1, 9*b*2/10*b*2, 9*d*1/10*d*1, and 9*d*2/10*d*2 around the horizontal axes parallel to the width of the box 1, in order to break the connections between said upper sections, two by two, but that in this case, only two of said upper sections would have been folded towards the exterior of said box 1.

Following the break of the connection between the upper sections 1*ah*, 1*bh*, 1*ch*, and 1*dh* of the side walls 1*a*, 1*b*, 1*c*, 1*d* of the box 1, said upper sections find themselves separated by the slits 28*ab*, 28*bc*, 28*cd*, and 28*da*.

After opening the clamps and their retraction, said upper sections are now folded towards the interior of the box, by means such as pushing elements known by the state of the art, so as to bring them into a horizontal or essentially horizontal plane by constituting now the upper closing wall of said box. During this folding, the upper sections constitute flaps or overlaps which swing around the axes 11*a*, 11*b*, 11*c*, and 11*d*, by creating fold lines 8*a*, 8*b*, 8*c*, and 8*d*.

It is clear that the clamps serve only to seize and bend towards the exterior said upper sections which then return to their vertical starting position. Their folding towards the interior occurs after the retraction of said clamps, for example on another station of the machine.

Figure 8:
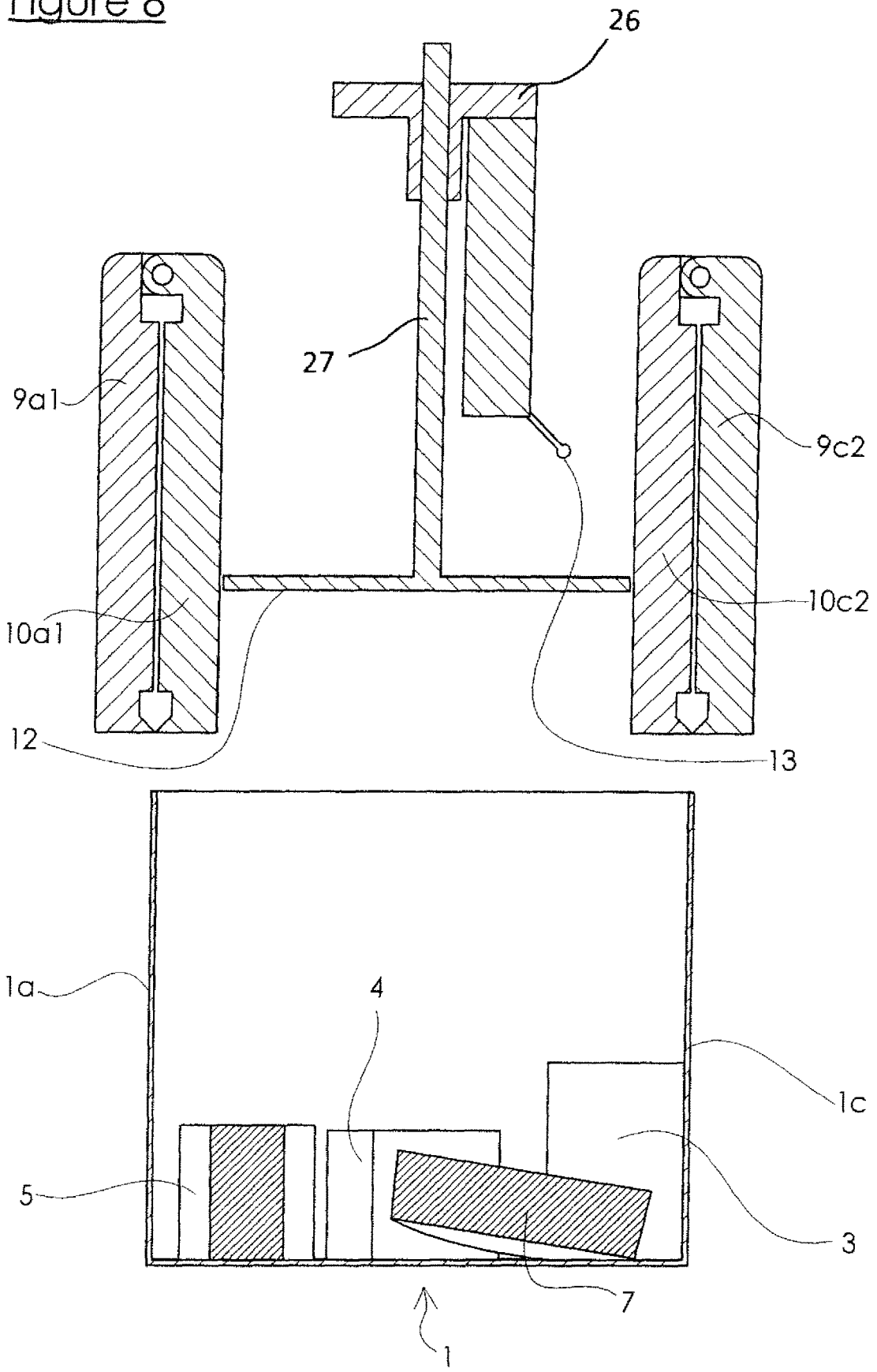
FIGS. 8 and 9 are two section views of the box and of a part of a machine for the implementation of the method according to the invention at two successive stages.

FIG. 8 is a section view of the box 1 and of a part of a machine for the implementation of the method according to the invention, in a plane parallel to the width of said box 1 and passing through the center of said box.

This figure shows the clamps 9*a*1/10*a*1 and 9*c*2/10*c*2 intended for seizing the upper sections of the side walls 1*a* and 1*c* respectively of said box 1.

FIG. 8 also shows the feeler 12, which is mobile along a vertical axis relative to said clamps, as well as the sensor 13 whose function is to detect the position of said feeler 12. The feeler 12 may be constituted by a plate the shape and dimensions of which correspond approximately to the shape and dimensions of the base 1*e* of the boxes 1. The sensor 13 may be constituted by a device known as such. This sensor 13 may be mounted with a capability of vertical movement relative to the feeler 12. For this purpose, it may be carried by a slide block 26 mounted so it can slide along a vertical slide channel 27 whose lower end is equipped with the feeler 12 (FIGS. 8 and 9).

Also visible on FIG. 8 are the objects 3, 4, 5, and 7 previously placed in said box 1. It is noted that the items situated in the background of this cross-section, such as the clamps 9*d*1/10*d*1 and 9*d*2/10*d*2 have not been drawn, for the sake of clarity of the representation.

Figure 9:
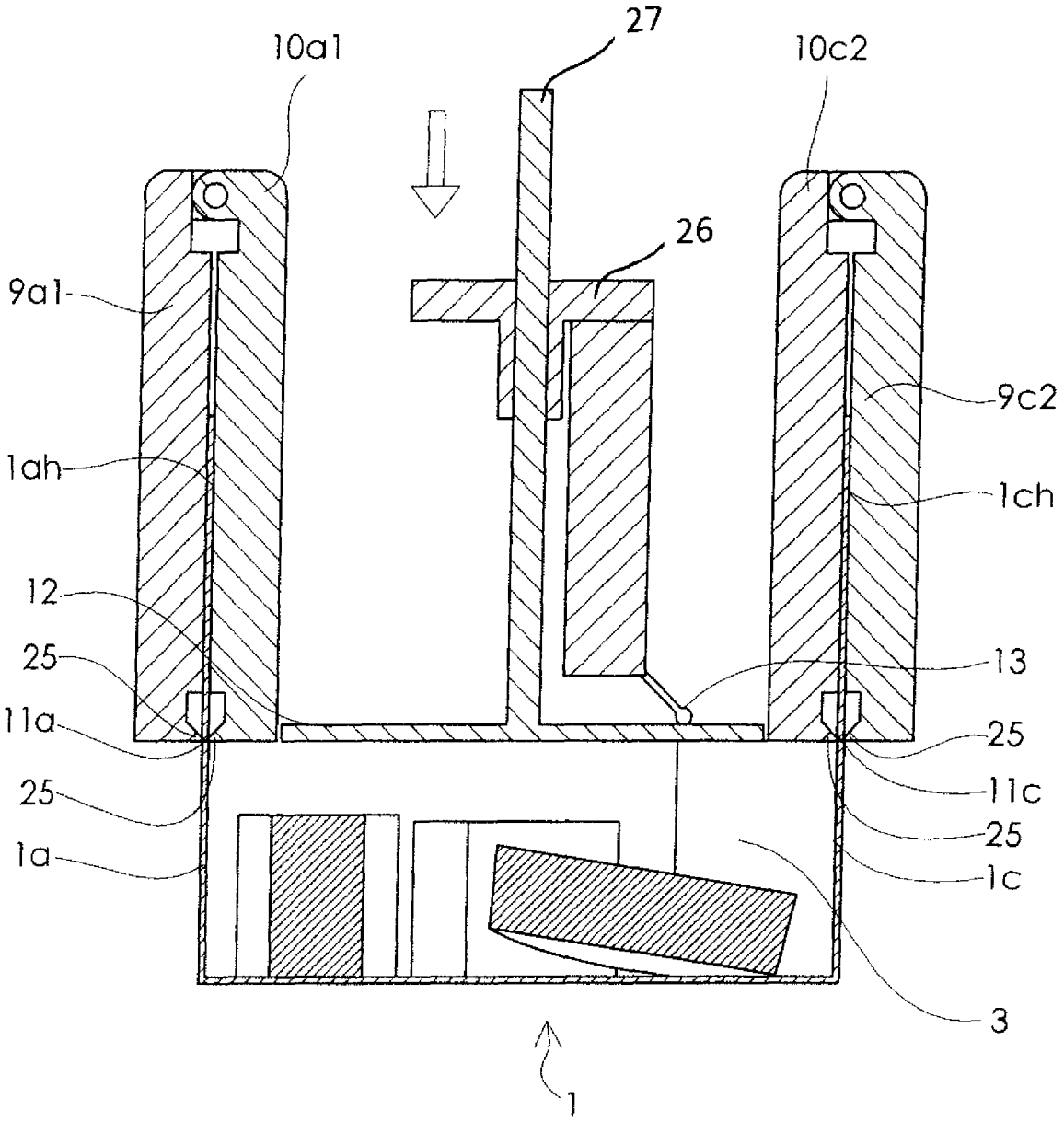

FIG. 9 is similar to FIG. 8 but shows the box 1 and said part of machine at a following stage of the method according to the invention.

One sees on FIG. 9 that said clamps 9*a*1/10*a*1, 9*c*2/10*c*2, said feeler 12 and said sensor 13 have been moved towards said box 1, by means not shown such as for example actuators or other activators associated to a transmission by drive-belt, chain, mechanism of the connecting rod/crank type or any other appropriate means, so that the upper portion 1*ah* of the side wall 1*a* has been introduced between the two jaws of the clamp 9*a*1/10*a*1 and that the upper portion 1*ch* of the side wall 1*c* has been introduced between the two jaws of the clamp 9*c*2/10*c*2. It is also clear that a similar result could have been obtained by moving said box 1 towards said clamps 9*a*1/10*a*1 and 9*c*2/10*c*2, and towards the assembly constituted by said feeler 12 and said sensor 13.

One also sees that, during this movement, said feeler 12 comes first into contact with object 3, its highest point being the top of the stack constituted by said objects, which stops the descending motion of said feeler 12, then that the movement of said clamps 9*a*1/10*a*1 and 9*c*2/10*c*2 and of said sensor 13 has taken place until said sensor 13 comes into contact with said feeler 12 and it is clear that the control system which guides said movement has then stopped this movement. One also sees that the position of said sensor 13 is such that the contact between said sensor 13 and said feeler 12 occurs when the low end of the jaws of said clamps 9*a*1/10*a* 1 and 9*c*2/10*c*2 is located at a height essentially equal to that of the highest point of object 3, i.e., at a height equal to that of the top of the stack of objects previously placed in said box 1 and that this is true whatever the height of said stack of objects may be.

The folding of the upper sections 1*ah*, 1*bh*, 1*ch*, 1*dh*, in the horizontal position, towards the center of the box 1, can be facilitated by providing horizontal scores or grooves at the axes 11*a*, 11*b*, 11*c*, 11*d*, these scores or grooves may occupy the entire distance comprised between the bottom of two consecutive slits 28*ab*, 28*bc*, 28*cd*, and 28*da* or only a part of this distance. They are obtained by crushing the material used for the manufacture of the box, for example under the pressure of an appropriate tool.

One sees, for example on FIGS. 8 and 9, that the jaws 9*a*1, 10*a*1, 9*c*2 and 10*c*2 each possess, in the lower part, a beveled edge 25, these beveled edges being positioned facing each other (FIG. 8) which enables them to crush the side walls 1*a* and 1*c* in this area, as said jaws of the clamp approach. It is known that this area corresponds to the position of the axes 11*a*, 11*b*, 11*c*, 11*d* around which said jaws 9*a*1/10*a*1 and 9*c*2, 10*c*2 are then going to be pivoted and thereby the upper portion 1*ah* and 1*ch* of said side walls 1*a* and 1*c*, by facilitating the creation of folding lines 8*a* and 8*c*. It is clear that these scores or grooves can be of reduced length sufficient to facilitate the creation of folding lines 8*a*, 8*b*, 8*c*, 8*d*, over the entire length of the small sides and of the large sides of the box 1, but they may also be advantageously made over the entirety or over a part of the distance separating the bottoms of the slits 28*ab*, 28*bc*, 28*cd*, and 29*da* situated on the axes 11*a* and 11*c* and around which said upper sections 1*ah* and 1*ch* are going to be folded and this by using clamps of significant size.

According to a variant of implementation, only one of the two jaws of each clamp may feature a beveled edge 25 for producing the scores or grooves in one of the faces of the side walls made of carton or any other foldable material.

It is also clear the explanations given for the mechanisms which appear on FIGS. 8 and 9 which represent section views in a plane that is parallel to the width of said box 1, are also applicable to the mechanisms which would appear on other section views, for example in a plane parallel to the length of said box 1, if corresponding figures were produced.

Figure 10:
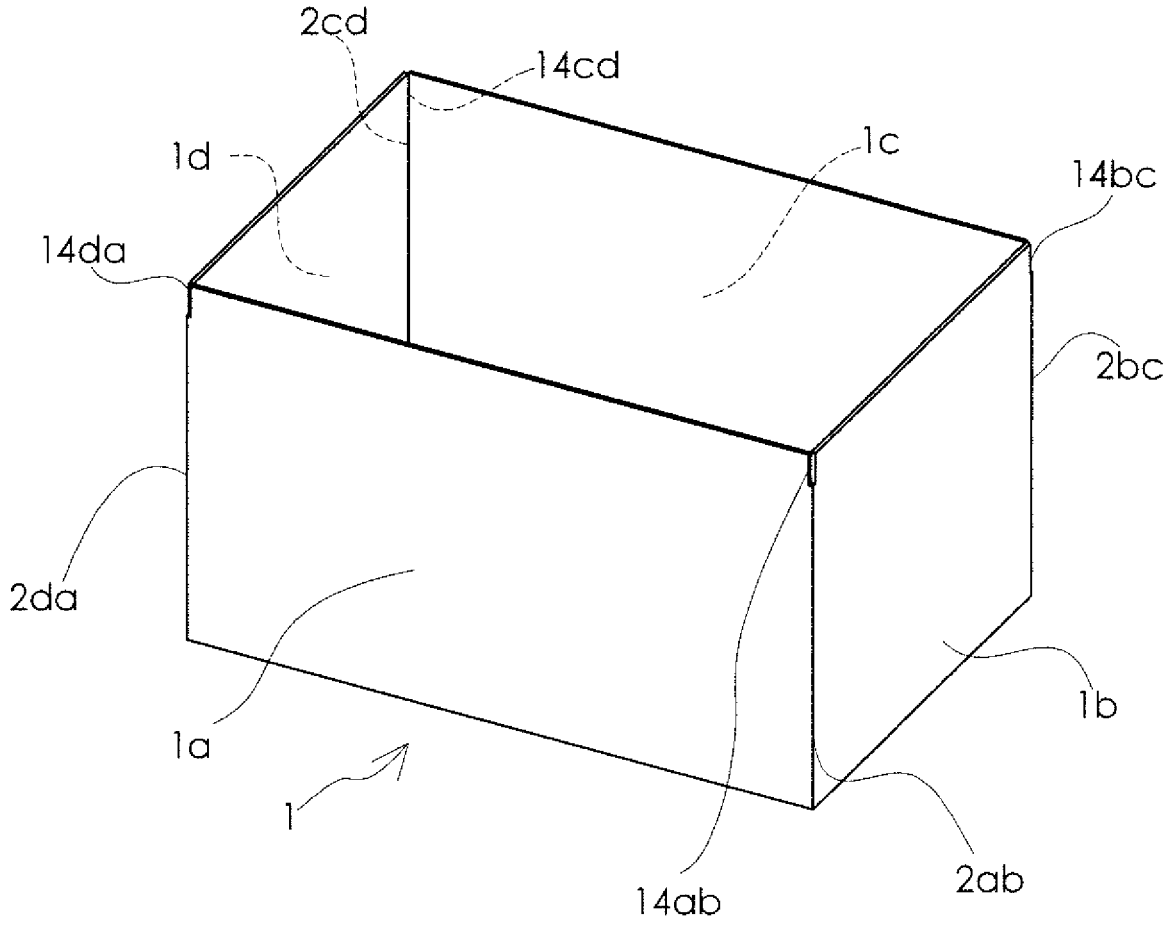
FIG. 10 is an isometric view of an empty box usable for the implementation of the method according to the invention.

FIG. 10 shows said box 1 before implementation of the method according to the invention. One sees on FIG. 10 the four side walls 1*a*, 1*b*, 1*c*, and 1*d* of said box 1. One also sees the edges 2*ab*, 2*bc*, 2*cd*, and 2*da* where the links between said side walls, two by two, are situated.

One also sees that said box 1 has a cutouts 14*ab*, 14*bc*, 14*cd*, 14*da*, made at the vertical edge 2*ab*, 2*bc*, 2*cs*, 2*da* where the connection is situated between said side walls 1*a* and 1*b*, 1*b* and 1*c*, 1*c* and 1*d*, 1*d* and 1*a*. This cutout has been made at a reduced height, for example in the order of a few millimeters, from the rim of the box.

It is clear that such a cutout of reduced height is intended to facilitate the implementation of the method according to the invention in the sense that it constitutes a starting point from which the break of the connection between said side walls of the box, for example between the side walls 1*a* and 1*b*, will be able to spread easily up to the level of the top of the stacked object previously placed inside said box 1, when the upper sections 1*ah* and 1*bh* of the side walls 1*a* and 1*b* of said box are being folded back, within the framework of implementation of the method according to the invention, such as described for example in the explanations given for FIG. 7. One also sees the cutouts 14*bc*, 14*cd*, and 14*da* and it is clear that these play the same role for the break of the connections between, respectively, the side walls 1*a* and 1*b*, 1*c* and 1*d*, and 1*d* and 1*a*.

It is also known that for the complete implementation of the method according to the invention, making it possible to obtain a closed box such as described for example in the explanations provided for FIG. 5, the height of each of said upper sections 1*ah*, 1*bh*, 1*ch*, and 1*dh* must be at least equal to the half-width of said box 1, and that consequently said cutouts 14*ab*, 14*bc*, 14*cd*, and 14*da* may have a height at the most equal to the half-width of said box 1, so that, under these conditions, the low point of said cutouts will always be situated above or perhaps at the same level as the top of the stack of objects previously placed into said box 1.

Figure 11:
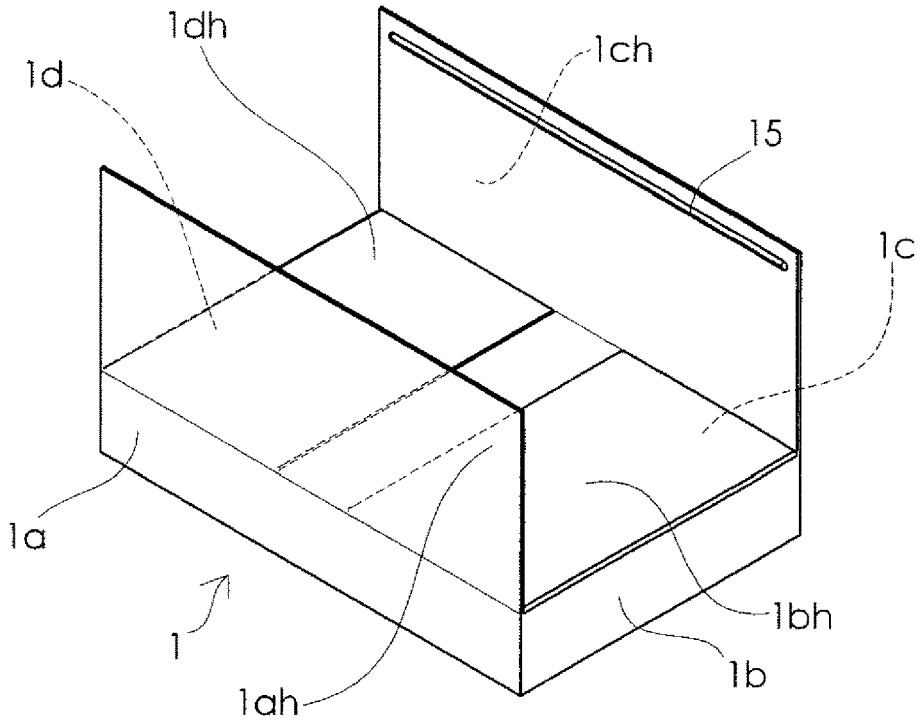
FIGS. 11 and 12 are isometric views of the box at an intermediate stage of the method according to two different examples of implementation of this method.

FIG. 11 shows said box 1 after implementation of the first steps of the method according to the invention. One knows, through the explanations given for FIG. 5, that the box 1 can be kept closed after implementation of said method by providing a means to keep said upper sections 1*ah* and 1*ch* in the horizontal plane, after folding said upper sections towards the interior of said box 1.

FIG. 11 shows said upper sections 1*bh* and 1*dh*, already folded back towards the interior of said box 1, in the horizontal plane. It also shows said upper sections 1*ah* and 1*ch* which are not yet folded back, and on the internal face of the upper portion 1*ch* a bead of glue deposited in proximity of the upper high edge of said upper portion 1*ch*. It is clear then that said bead of glue 15 will be put into contact with the external face of the upper portion 1*ah* if said upper portion 1*ah* is folded back towards the inside of the box 1, in the horizontal plane. It is clear that said bead of glue 15 will enable said upper sections 1*ah* and 1*ch* to be connected to each other after the folding and thereby to keep them, as well as the upper sections 1*bh* and 1*dh*, in the horizontal plane, thus providing a means for keeping said box 1 closed.

Figure 12:
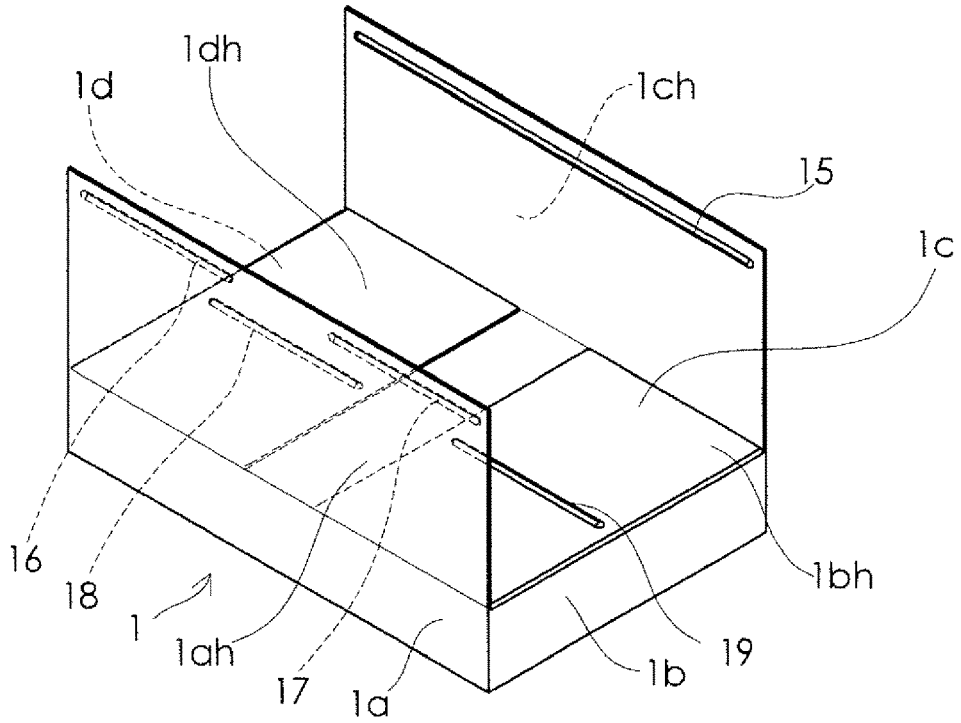

FIG. 12 shows said upper sections 1*bh* and 1*dh*, already folded towards the interior of said box 1, in the horizontal plane. It also shows said upper sections 1*ah* and 1*ch*, not yet folded back, and it shows, on the internal face of the upper portion 1*ch*, a bead of glue 15, deposited in proximity of the upper high edge of the upper portion 1*ch*. It also shows, on the internal face of the upper portion 1*ah*, two beads of glue 16 and 17, deposited in proximity of the upper high edge of said upper portion 1*ah*. And it also shows a bead of glue 18, deposited on the external face of said folded upper portion 1*dh* as well as a bead of glue 19, deposited on the external face of said folded upper portion 1*bh*.

It is then clear that, if first of all said upper portion 1*ah* is folded towards the interior of the box 1, in the horizontal plane, said beads of glue 16 and 18 will enable said upper sections 1*ah* and 1*dh* to be connected to each other and said beads of glue 17 and 19 will enable said upper sections 1*ah* and 1*bh* to be connected to each other, and thereby to keep them in the horizontal plane and if one then folds said upper portion 1*ch* towards the interior of said box 1, in the horizontal plane, said bead of glue 15 will enable said upper sections 1*ah* and 1*ch* to be connected to each other, and thereby to keep them, as well as said upper sections 1*bh* and 1*dh*, in the horizontal plane.

It thus becomes clear that these various beads of glue 15, 16, 17, 18, and 19 provide means to keep said box 1 reliably and hermetically closed, whatever the height of said upper sections 1*ah*, 1*bh*, 1*ch*, and 1*dh*, comprised between the half-width and the width of said box 1.

Figure 13:
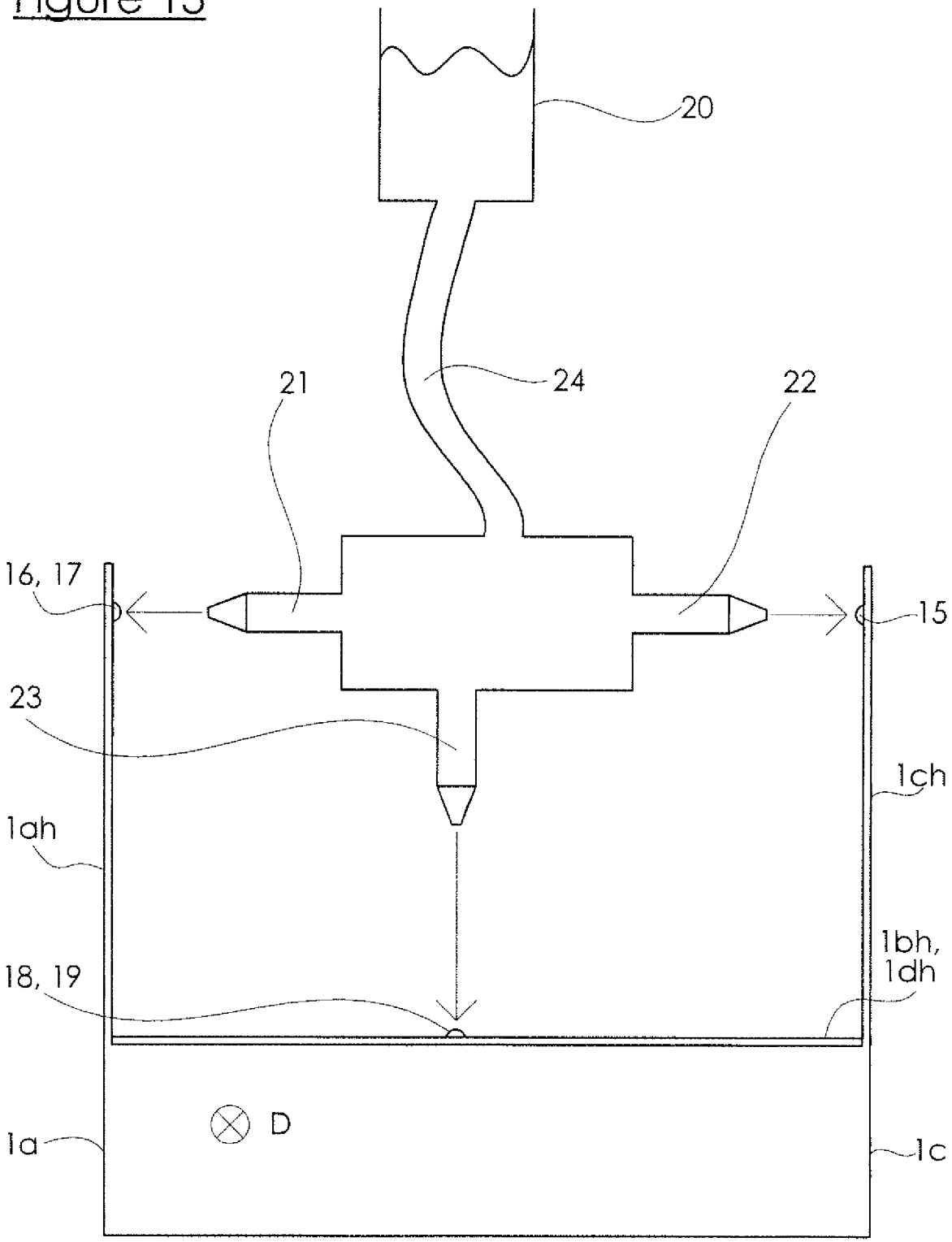
FIG. 13 is a side view of the box and a part of a machine for the implementation of the method according to the invention.

FIG. 13 shows said box 1 after the first stages of the method according to the invention.

FIG. 13 shows that the upper portion 1*dh*, and also the upper portion 1*bh* which is no longer visible in this figure, have been folded towards the interior of the box 1, in the horizontal plane. It is clear that said folding has been done at the level of the top of the stack of items previously placed inside said box 1.

FIG. 13 also shows the beads of glue 15, 16, 17, 18, and 19. It shows that said bead of glue 15 is deposited on the upper portion 1*ch*, that said beads of glue 16 and 17 are deposited on the upper portion 1*ah* and, thanks to FIG. 12, it is known that said bead of glue 18 is deposited on the upper portion 1*dh* and that the bead of glue 19 is deposited on the upper portion 1*bh*.

FIG. 13 also shows a gluing system constituted by a glue tank 20, gluing nozzles 21, 22, and 23 and a tube 24 which connects said gluing nozzles to said tank.

It is clear that said gluing nozzles may each be equipped with a device, not shown on FIG. 13, enabling them to project glue when the control system of said gluing system commands them to do so.

One also sees that said beads of glue 15, 16, 17, 18, and 19 are all parallel to each other, and it is thus clear that depositing said beads of glue is easy to do, by moving said box 1 under said gluing system according to the direction D parallel to said beads of glue and by ordering, by means of said control system, the projection of glue for each of said nozzles 21, 22, and 23 at the proper time so that said beads of glue be deposited on said upper sections 1*ah*, 1*bh*, 1*ch*, and 1*dh* at the desired location.

From the preceding description, one still retains that the machine according to the invention features means permitting, on the one hand, to exert a force directed towards the exterior on the upper portion (1*ah*, 1*bh*, 1*ch*, 1*dh*) of at least two opposing side walls (1*a*, 1*c* or 1*b*, 1*d*) of a box 1 made of a foldable material such a carton or other and consisting of a base 1*e* and of four inter-connected side walls (1*a*, 1*b*, 1*c*, 1*d*) forming angles of 90°, so as to break the connections between said upper sections, and, on the other hand, to then fold all upper sections (1*ah*, 1*bh*, 1*c*, 1*dh*) towards the interior of the box to bring them back into an essentially horizontal plane. This machine thus makes it possible to adapt the height of the useful volume of the box to the height of the group of objects or of the stack of objects (3, 4, 5, 6, 7) placed in said box.

According to the invention, said means are constituted by tooling including at least two clamps (9*a*1/10*a*1, 9*a*2/10*a*2, 9*b*1/10*b*1, 9*b*2/10*b*2, 9*c*1/10*c*1, 9*c*2/10*c*2, 9*d*1/10*d*1, 9*d*2/10*d*2) featuring, each, at least two vertical jaws driven, on the one hand, by a first motor for bringing them closer together to be able to seize, by a clamping action, the upper portion of at least two side walls of the box, and on the other hand, driven by a second motor for applying a force (Fa, Fb, Fc, Fd) directed towards the exterior, on said upper sections of said two side walls, so as to break the connections between the latter.

According to an advantageous implementation, the tooling includes at least four clamps (9*a*1/10*a*1, 9*a*2/10*a*2, 9*b*1/10*b*1, 9*b*2/10*b*2, 9*c*1/10*c*1, 9*c*2/10*c*2, 9*d*1/10*d*1, 9*d*2/10*d*2) each positioned on the sides of a quadrangle for bending the upper sections of the side walls of the box 1 towards its exterior.

Preferably, the tooling includes two clamps positioned on each side of said quadrangle. These two clamps being situated at a distance from each other, and so positioned that they can seize the upper sections of the side walls of the box, in proximity of the vertical ridges of said box. An example of implementation of such an arrangement is illustrated in FIG. 7 which shows that the clamping assembly is constituted by eight clamps 9*a*1/10*a*1, 9*a*2/10*a*2, 9*b*1/10*b*1, 9*b*2/10*b*2, 9*c*1/10*c*1, 9*c*2/10*c*2, 9*d*1/10*d*1, 9*d*2/10*d*2.

In order not to lengthen and needlessly complicate the description and the drawings, there is no description of the activators of the actuators or any other device for bringing the jaws of the clamps 9*a*1/10*a*1, 9*a*2/10*a*2, 9*b*1/10*b*1, 9*b*2/10*b*2, 9*c*1/10*c*1, 9*c*2/10*c*2, 9*d*1/10*d*1, 9*d*2/10*d*2 closer together or further apart, nor of the process controllers, nor of the drive motors, nor of the detection and transmission devices which ensure the proper functioning of the tools (clamps) of the machine, as these different devices do not fall within the framework of the invention and are well known by the experts.

The machine for cushioning and confinement of objects inside a box 1 made of a foldable material, carton for example and consisting of a base 1*e* of square or rectangular shape, or approximately square or rectangular, and of four side walls 1*a*, 1*b*, 1*c*, 1*d*, features, according to the invention, tooling for adapting the height of the useful volume of the box to the height of the stack of objects 3, 4, 5, 6, and 7, placed inside it and for ensuring the closure of said box, and means for moving this tooling so as to position it above said box 1, or means for moving said box 1 to position it below said tooling which comprises at least two clamps 9*a*1/10*a*1, 9*a*2/10*a*2, 9*b*1/10*b*1, 9*b*2/10*b*2, 9*c*1/10*c*1, 9*c*2/10*c*2, 9*d*1/10*d*1, 9*d*2/10*d*2, each featuring two vertical jaws, said clamps being mounted, on the one hand, to a first motor for bringing said jaws closer together so they can seize, by a clamping action, the upper portion of at least two side walls of the box, and, on the other hand, to a second motor enabling them to apply a force Fa, Fb, Fc, Fd directed towards the exterior, on said two upper sections 1*ah*, 1*bh*, 1*ch*, 1*dh* so as to break the connections between said upper sections.

According to another characteristic arrangement, the machine comprises at least four clamps 9*a*1/10*a*1, 9*a*2/10*a*2, 9*b*1/10*b*1, 9*b*2/10*b*2, 9*c*1/10*c*1, 9*c*2/10*c*2, 9*d*1/10*d*1, 9*d*2/10*d*2 positioned each on one of the sides of a quadrangle, to seize and to bend the upper sections of four side walls of the box towards its exterior.

Preferably, said tooling comprises two clamps positioned on each of the four sides of the quadrangle, these two clamps being placed at a distance from each other and positioned to seize the upper sections of the side walls of the box 1, in proximity of the angles formed by the connection of said side walls.

It is emphasized that the clamps could also have jaws featuring a clamping length corresponding to the distance between the bottom of two successive slits 28*ab*, 28*bc*, 28*cd*, 28*da*.

Advantageously, the lower edge of at least one of the jaws of the clamps and, preferably, the lower edge of each jaw 9*a*1, 9*a*2, 9*b*1, 9*b*2, 9*c*1, 9*c*2, 9*d*1, 9*d*2, 10*a*1, 10*a*2, 10*b*1, 10*b*2, 10*c*1, 10*c*2, 10*d*1, 10*d*2 presents a bevel 25 oriented in the direction of the other jaw, in order to achieve a compression of the material the box is made of, at the locations compressed by these beveled edges, the scores or grooves resulting from this compression forming folding lines or the beginnings of folding lines facilitating the folding of the upper sections of the side walls towards the interior.

On the other hand, the machine features a vertically mobile feeler 12 and a sensor 13 and one in relation to the other, the shape and the general dimensions of this feeler 12 corresponding essentially to the shape and dimensions of the base 1*e* of the box 1 so as to be able to move vertically between the vertical walls of the box, the sensor 13 being connected to the process controller guiding the movements as well as the closing and opening of the jaws.

The invention claimed is:

1. A method to reduce a height of a box made of a foldable material, the box including a base and side walls interconnected at a right angle by forming vertical ridges, up to a top of a stack of objects previously placed into said box, without removal of a part of the foldable material of said box nor utilization of any cutting tool, wherein the side walls include at least four side walls, the method comprising:

breaking the connections between upper sections of said side walls along an upper portion of the vertical ridges of said box from the top of said side walls of the box to a level of the top of said stack of objects previously placed inside the box by exerting a force, directed towards an exterior of said box, on the upper sections of at least two of said side walls situated above the level of the top of said stack of objects;

simultaneously folding, towards the exterior of said box, said upper sections of the at least two of said side walls on which said force is exerted;

folding the upper sections of said side walls towards an interior of said box to bring the upper sections of said side walls into a horizontal plane; and seizing said side walls in an area situated between the top of said box and the top of said stack of objects using clamps, wherein each of the clamps includes at least two jaws capable of being brought closer together or being moved further apart from each other, one of the jaws acting on an outside face of one of the side walls, the other one acting on an inside face of the one of the side walls, and wherein each of said clamps is configured to be rotated in a direction of the exterior of said box around a rotational axis situated on said side walls and at the top of said stack of objects.

2. The method of claim 1, wherein the clamps are positioned in proximity of the vertical ridges of the box when the upper sections of the side walls are seized.

3. The method of claim 1, further comprising:

moving, in a direction perpendicular to the base of said box, at least one of said box towards said clamps or said clamps towards said box, in a movement that is perpendicular to the base of said box; and stopping the moving upon detection, by a detection device, a relative movement between said clamps and said detection device.

4. The method of claim 3, wherein the detection device includes a feeler having a shape and general dimensions corresponding to the shape and dimensions of the base of said box.

5. The method of claim 1, further comprising:

prior to folding the upper sections of said side walls towards the interior of said box, making a score at the level of the rotational axis around which the folding is to be executed, wherein the score is situated on said side walls and at the level of the top of said stack of objects.

6. The method of claim 5, further comprising:

before applying a force directed towards the exterior of said box on the upper portion situated above the level of the top of the stack of objects located in said box, making a score in said side walls at a height corresponding to the level of the stack of objects placed inside the box by the lower end of the jaws of the clamps, at least one of which features a beveled edge oriented in a direction of the other one of said jaws.

7. The method of claim 1, wherein the box includes slits of reduced height, made from the top of said box, at the vertical ridges where the connections between said side walls are situated.

8. The method of claim 1, further comprising:

depositing a first bead of glue on at least one face of at least one of said upper sections so that said bead of glue makes at least two of said upper sections of said side walls adhere to each other to keep said upper sections in the horizontal plane.

9. The method of claim 8, further comprising:

depositing a second bead of glue on the inside face of at least one of said upper sections of said side walls as well as one or several beads of glue on the inside and/or outside of at least one more of said upper sections of said side walls and said non-glued upper sections of said side walls are folded first, then said previously glued upper sections of said side walls are successively folded so that said first and second beads of glue do not come into contact with said stack of objects but ensure adhesion of several of said upper sections of said side walls to each other and keep all of said upper sections of said side walls in the horizontal plane.

10. The method of claim 9, wherein said first and second beads of glue are parallel to each other and that the deposition of said first and second beads of glue is obtained by projection of glue from a glue tank using fixed gluing nozzles during travel of said box in a direction parallel to said first and second beads of glue.

* * * * *